US010996599B2

(12) United States Patent
Himeno

(10) Patent No.: US 10,996,599 B2
(45) Date of Patent: May 4, 2021

(54) FIXING DEVICE WITH A MOVABLE BELT REGULATING MEMBER AND IMAGE FORMING APPARATUS

(71) Applicant: TOSHIBA TEC KABUSHIKI KAISHA, Tokyo (JP)

(72) Inventor: Satoshi Himeno, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/576,668

(22) Filed: Sep. 19, 2019

(65) Prior Publication Data

US 2021/0088950 A1 Mar. 25, 2021

(51) Int. Cl.
*G03G 15/20* (2006.01)
*G03G 21/16* (2006.01)

(52) U.S. Cl.
CPC ..... *G03G 15/2053* (2013.01); *G03G 15/2017* (2013.01); *G03G 15/2064* (2013.01); *G03G 21/1685* (2013.01); *G03G 2215/2016* (2013.01); *G03G 2215/2019* (2013.01); *G03G 2215/2035* (2013.01); *G03G 2215/2041* (2013.01)

(58) Field of Classification Search
CPC ..... G03G 15/2017; G03G 15/2053; G03G 21/1685; G03G 2215/2016; G03G 2215/2019; G03G 2215/2035; G03G 2215/2041; G03G 15/2064
See application file for complete search history.

(56) References Cited

U.S. PATENT DOCUMENTS

2011/0318076 A1* 12/2011 Tanda ..... G03G 15/2007 399/329
2013/0164056 A1* 6/2013 Imada ..... G03G 15/2053 399/329
2018/0284668 A1* 10/2018 Lee ..... G03G 21/1647

OTHER PUBLICATIONS

U.S. Appl. No. 16/504,432, filed Jul. 8, 2019, Satoshi Himeno.

* cited by examiner

*Primary Examiner* — Joseph S Wong
(74) *Attorney, Agent, or Firm* — Foley & Lardner LLP

(57) ABSTRACT

Certain embodiments provide a fixing device, for fixing a toner image formed on an image receiving medium to the image receiving medium, including: a pressure rotation member; a pressure member against which the pressure rotation member is pressed across the image receiving medium; a heating roller separated from the pressure member and configured to rotate around a rotation axis thereof; an annular belt wound around the heating roller and the pressure member; a belt regulating member configured to include an opening into which the heating roller is loosely fitted and an abutting surface abutting against the annular belt; and a stopper arranged to face an outer edge of the annular belt contacting the heating roller across the belt regulating member.

20 Claims, 10 Drawing Sheets

FIXING DEVICE WITH A MOVABLE BELT REGULATING MEMBER AND IMAGE FORMING APPARATUS

FIELD

Embodiments described herein relate generally to a fixing device and an image forming apparatus.

BACKGROUND

In a fixing device, a nip is formed by a pressure roller pressed against a pressure pad across a fixing belt. The fixing belt rotates around a heating roller and the pressure pad. The fixing belt may move in an axial direction of a rotation axis of the heating roller during rotation.

A belt regulating plate is provided to regulate the movement of the fixing belt along the axial direction of the heating roller. A conventional belt regulating plate is supported in such a manner that the rotation axis of the heating roller is perpendicular to a flat surface thereof for regulating the belt.

However, in such a configuration, an external force is applied to an area of the fixing belt which is not wound around the heating roller. Specifically, a reaction force for pushing back the fixing belt by the belt regulating plate and a rotational force of the belt regulating plate are applied to the fixing belt. Since an area of the fixing belt which is not wound around the pressure roller has low strength, there is a possibility that the area not wound around the pressure roller is damaged if an external force is applied thereto.

DETAILED DESCRIPTION

Certain embodiments provide a fixing device for fixing a toner image formed on an image receiving medium to the image receiving medium, including: a pressure rotation member; a pressure member against which the pressure rotation member is pressed across the image receiving medium; a heating roller separated from the pressure member and configured to rotate around a rotation axis thereof; an annular belt wound around the heating roller and the pressure member; a belt regulating member configured to include an opening into which the heating roller is loosely fitted and an abutting surface abutting against the annular belt; and a stopper arranged to face an outer edge of the annular belt contacting the heating roller across the belt regulating member.

Hereinafter, an image forming apparatus according to the present embodiment is described with reference to the accompanying drawings. In the description, an XYZ coordinate system composed of X, Y and Z axes orthogonal to one another is used as appropriate. An image forming apparatus 10 according to the present embodiment is, for example, an Multi-Function Peripheral (MFP).

[MFP]

Figure 1:
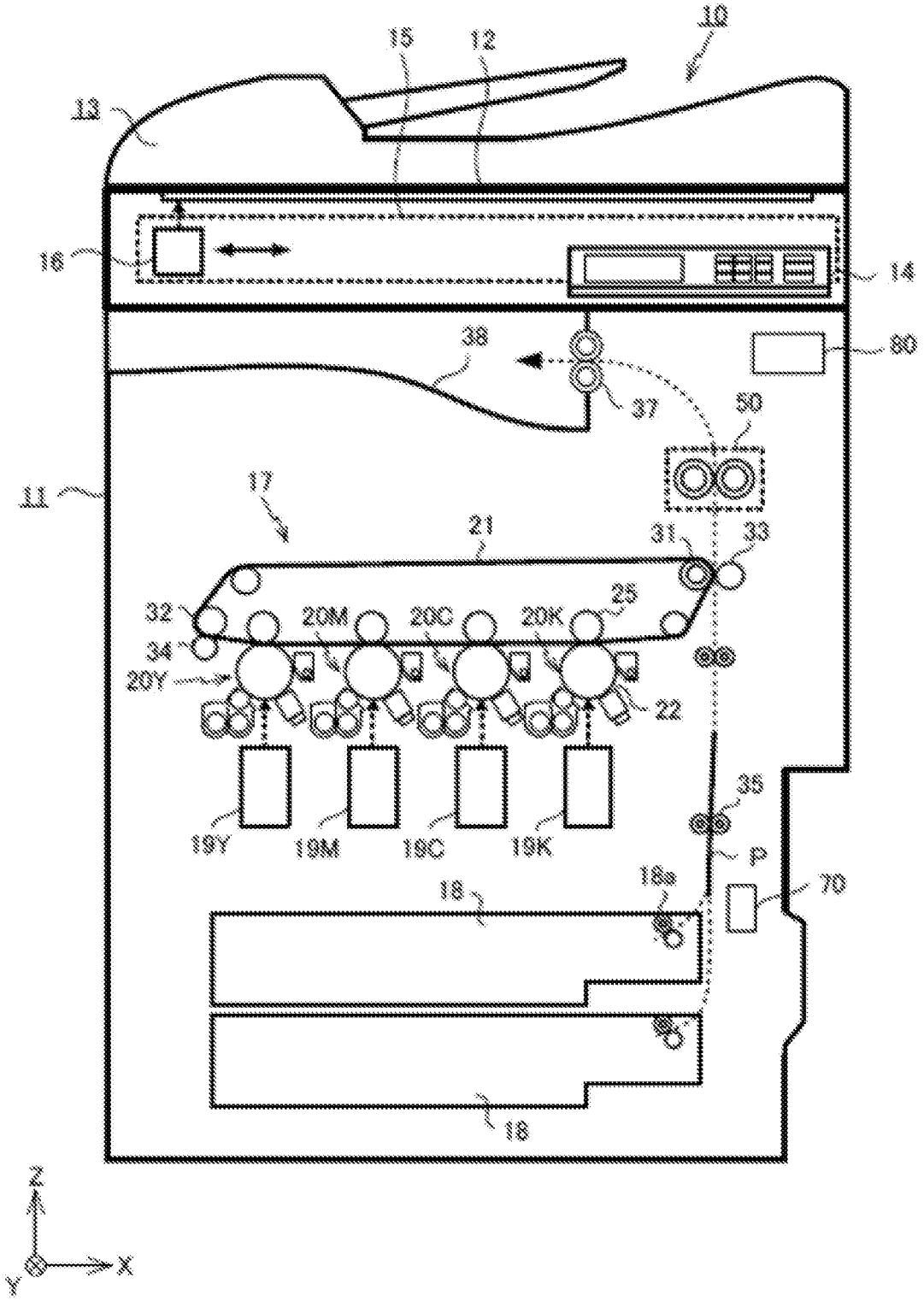
FIG. 1 is a diagram schematically illustrating a configuration of an image forming apparatus according to an embodiment.

FIG. 1 is a diagram schematically illustrating a configuration of the MFP 10 according to the present embodiment. The MFP 10 includes a main body 11 and an automatic document feeder (ADF) 13. A document table 12 made of transparent glass is arranged on the top of the main body 11, and the automatic document feeder 13 is arranged on an upper surface side of the document table 12 in such a manner that the automatic document feeder 13 can rise, fall and pivot. An operation panel 14 is arranged at an upper portion of the main body 11. Below the document table 12, a scanner 15 for reading a document is arranged.

The operation panel 14 includes various keys, a Graphical User Interface (GUI) and the like.

The scanner 15 reads a document fed by the automatic document feeder 13 or a document placed on the document table 12 to generate image data. The scanner 15 is provided with an image sensor 16.

When reading an image of a document placed on the document table 12, the image sensor 16 reads the image of the document while moving in a +X direction along the document table 12. When reading an image of a document fed to the document table 12 by the automatic document feeder 13, the image sensor 16 is fixed at a position shown in FIG. 1 and reads an image of each document among sequentially fed documents.

The main body 11 includes an image forming section 17, a fixing device 50, a sensor 70 and a control device 80.

[Image Forming Section]

The image forming section 17 is arranged at the inside of the main body 11. The image forming section 17 forms an image on an image receiving medium such as a sheet accommodated in a sheet feed cassette 18 based on image data read by the scanner 15 or image data generated by a personal computer or the like.

The image forming section 17 includes image forming sections 20Y, 20M, 20C and 20K for forming latent images using toners of yellow (Y), magenta (M), cyan (C) and black (K), scanning heads 19Y, 19M, 19C and 19K arranged in correspondence with the image forming sections, an intermediate transfer belt 21 and the like.

The image forming sections 20Y, 20M, 20C and 20K are arranged below the intermediate transfer belt 21. In the image forming section 17, the image forming sections 20Y, 20M, 20C and 20K are arranged side by side from a −X side to a +X side. The scanning heads 19Y, 19M, 19C and 19K are arranged below the image forming sections 20Y, 20M, 20C and 20K, respectively.

Figure 2:
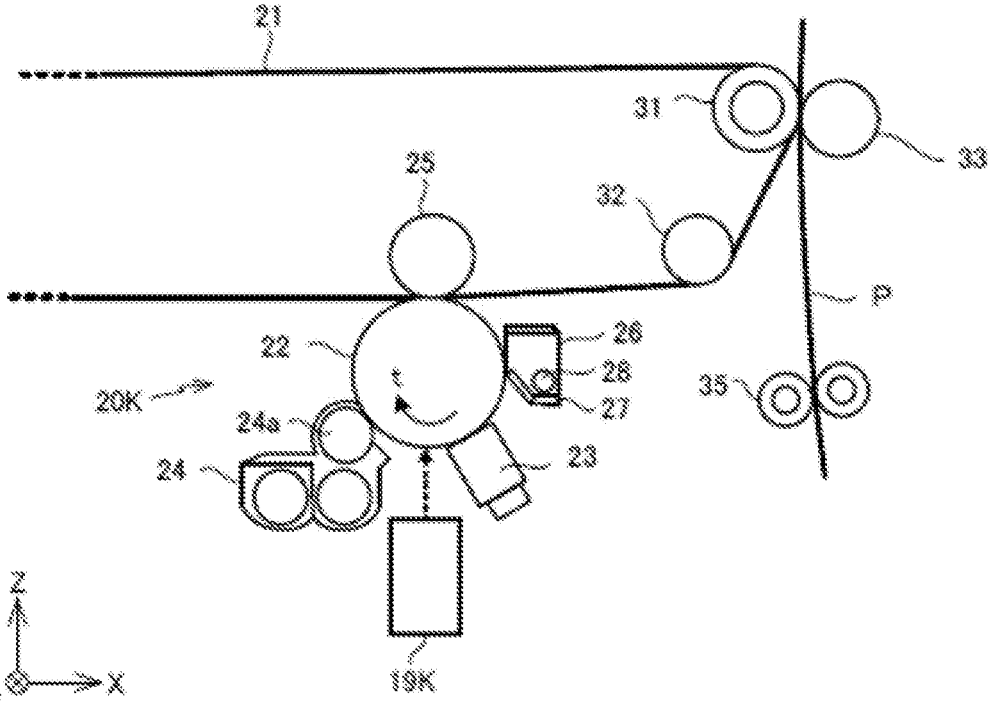
FIG. 2 is a diagram illustrating a configuration of an image forming section for black in the image forming apparatus according to the embodiment.

FIG. 2 is an enlarged view of the image forming section 20K among the image forming sections 20Y, 20M, 20C and 20K. The image forming sections 20Y, 20M, 20C and 20K have the same configuration. Therefore, the configuration of each image forming section is described using the image forming section 20K as an example.

The image forming section 20K has a photoconductive drum 22 serving as an image carrier. An electrostatic charger 23, a developing device 24, a primary transfer roller 25, a cleaner 26, a blade 27 and the like are arranged around the photoconductive drum 22 in a direction indicated by an arrow t. A laser beam is emitted from the scanning head 19K to an exposure position of the photoconductive drum 22. By irradiating a surface of the rotating photoconductive drum 22 with the laser beam, an electrostatic latent image is formed on the surface of the photoconductive drum 22.

The electrostatic charger 23 of the image forming section 20K uniformly charges the surface of the photoconductive drum 22. The developing device 24 feeds a toner to the photoconductive drum 22 through a developing roller 24*a* to which a developing bias is applied, to develop the electrostatic latent image. The cleaner 26 removes toner remaining on the surface of the photoconductive drum 22 with the blade 27. The toner scraped off through the tip of the blade 27 is conveyed by an auger 28 in a longitudinal direction thereof.

As shown in FIG. 1, the intermediate transfer belt 21 is stretched around a drive roller 31 and three driven rollers 32. The intermediate transfer belt 21 rotates counterclockwise in FIG. 1 as the drive roller 31 rotates. As shown in FIG. 1, the intermediate transfer belt 21 abuts against an upper surface of each of the photoconductive drums 22 of the image forming sections 20Y, 20M, 20C and 20K. A primary transfer voltage is applied by a primary transfer roller 25 to a position of the intermediate transfer belt 21 facing the photoconductive drum 22. In this way, a toner image developed on the surface of the photoconductive drum 22 is primarily transferred onto the intermediate transfer belt 21.

A secondary transfer roller 33 is arranged to face the drive roller 31 that stretches the intermediate transfer belt 21. At the time a sheet P passes between the drive roller 31 and the secondary transfer roller 33, a secondary transfer voltage is applied to the sheet P by the secondary transfer roller 33. In this way, the toner image formed on the intermediate transfer belt 21 is secondarily transferred onto the sheet P. In the vicinity of the driven roller 32 of the intermediate transfer belt 21, as shown in FIG. 1, a belt cleaner 34 is provided. The belt cleaner 34 removes the toner remaining on the surface of the intermediate transfer belt 21.

As shown in FIG. 1, a sheet feed roller 35 is provided between the sheet feed cassette 18 and the secondary transfer roller 33. The sheet P taken out of the sheet feed cassette 18 by a pickup roller 18*a* arranged in the vicinity of the sheet feed cassette 18 is conveyed between the intermediate transfer belt 21 and the secondary transfer roller 33 by the sheet feed roller 35.

The fixing device 50 is arranged above the secondary transfer roller 33. A sheet discharge roller 37 is arranged above the fixing device 50. The sheet P passing between the intermediate transfer belt 21 and the secondary transfer roller 33 is heated by the fixing device 50. In this way, the toner image is fixed to the sheet P. The sheet P passing through the fixing device 50 is discharged to a sheet discharge section 38 by the sheet discharge roller 37.

[Fixing Device]

Figure 3:
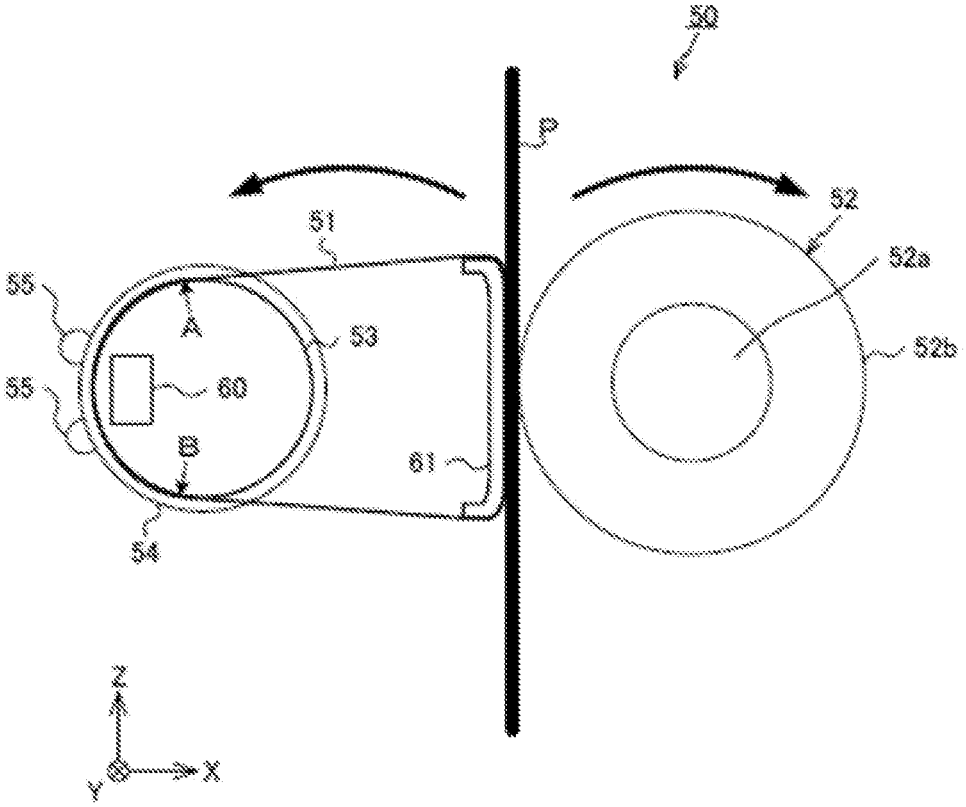
FIG. 3 is a diagram illustrating a configuration of a fixing device according to the embodiment.

FIG. 3 is a schematic diagram illustrating a configuration of the fixing device 50. The fixing device 50 includes a fixing belt 51, a pressure roller 52, a heating roller 53, a belt regulating plate 54, a stopper 55, a heater 60 and a pressure pad 61.

The fixing belt 51 that is an annular belt is wound around the heating roller 53 extending along a Y axis and the pressure pad 61 serving as a pressure member. The fixing belt 51 rotates along outer sides of the heating roller 53 and the pressure pad 61. The fixing belt 51 is a cylindrically shaped member extending in the Y-axis direction, and a length thereof is larger than a width of the sheet P (e.g., a dimension in the Y-axis direction thereof). The fixing belt 51 uses, for example, a SUS having a thickness of 50 μm or a film made of polyimide having heat resistance and a thickness of 70 μm as a base material. A silicone rubber layer having a thickness of 200 μm is formed on a surface of the base material. The silicone rubber layer is covered with a surface protective layer made of perfluoroalkoxy fluorine (PFA) resin or the like.

The pressure roller 52 serving as a pressure rotation member is arranged to face the pressure pad 61 at a distance from the pressure pad 61 and rotates around a rotation axis thereof. The pressure roller 52 is a cylindrical member extending in the Y-axis direction. The pressure roller 52 includes a core 52*a* made of metal such as aluminum, and a silicone rubber layer 52*b* laminated on an outer circumferential surface of the core 52*a*. The surface of the silicone rubber layer 52*b* is coated with PFA resin or the like. The pressure roller 52 has, for example, an outer diameter of about 25 mm and a length approximately equal to that of the fixing belt 51. The pressure roller 52 is energized by a pressure control mechanism (not shown) in a direction (−X direction) towards the fixing belt 51. In this way, the pressure roller 52 is pressed against the pressure pad 61 across the fixing belt 51. As a result, the surface of the pressure roller 52 closely contacts the surface of the fixing belt 51, and in this way, a nip through which the sheet P passes from a lower side to an upper side (e.g., in the +Z direction) is formed.

The heating roller 53 rotatably supports the fixing belt 51. The heating roller 53 is a cylindrically shaped member made of metal such as aluminum and extending in the Y-axis direction. An outer diameter of the heating roller 53 is, for example, about 20 mm.

The belt regulating plate 54 serves as a belt regulating member and prevents the fixing belt 51 from moving in the axial direction of the heating roller 53. The belt regulating plates 54 are arranged at a +Y side end and a −Y side end of the heating roller 53. The belt regulating plate 54 is made of a heat resistant plastic or the like. The belt regulating plate 54 has an opening into which the heating roller 53 is loosely fitted. Specifically, the belt regulating plate 54 is ring-shaped. In other words, the belt regulating plate 54 has a plate-like circular shape. An inner diameter of the opening of the belt regulating plate 54 is larger than an outer diameter of the heating roller 53. A difference between the inner diameter of the opening of the belt regulating plate 54 and the outer diameter of the heating roller 53 is, for example, 0.1 mm to 0.5 mm. The outer diameter of the belt regulating plate 54 is larger than the outer diameter of the heating roller 53. A difference between the outer diameter of the belt regulating plate 54 and the outer diameter of the heating roller 53 is, for example, 1 mm to 3 mm. The belt regulating plate 54 is loosely fitted into the heating roller 53, and is movable in the axial direction of the heating roller 53. A surface of the belt regulating plate 54 on the −Y side is an abutting surface that abuts against the fixing belt 51.

The stopper 55 is arranged to face the outer edge of the fixing belt 51 that contacts the heating roller 53 across the belt regulating plate 54. The stopper 55 is made of metal such as aluminum. The stopper 55 has, for example, a cylindrical shape. An outer diameter of the stopper 55 is, for example, 6 mm. One end of the stopper 55 is fixed to a housing 65 of the fixing device 50, and the other end thereof contacts the belt regulating plate 54. The belt regulating plate 54 is not fixed to the stopper 55. The stopper 55 is arranged at a surface of the belt regulating plate 54 on the +Y side such that the belt regulating plate 54 pushes only the outer edge of an area contacting the heating roller 53 in the fixing belt 51. The area contacting the heating roller 53 in the fixing belt 51 extends from A to B of the fixing belt 51 in the counterclockwise direction shown in FIG. 3. A and B shown in FIG. 3 indicate positions where the fixing belt 51 is separated from the heating roller 53.

The heater 60 heats the fixing belt 51. The heater 60 is arranged at the inside of the heating roller 53. The fixing belt 51 heated by the heater 60 serves as a heating rotation member that heats the sheet P.

Returning again to FIG. 1, the sensor 70 detects the sheet P being conveyed. As shown in FIG. 1, the sensor 70 is arranged at an upstream side of the fixing device 50. For example, the sensor 70 is arranged in the vicinity of the sheet feed cassette 18 or in the conveyance path.

[Control Device]

Figure 4:
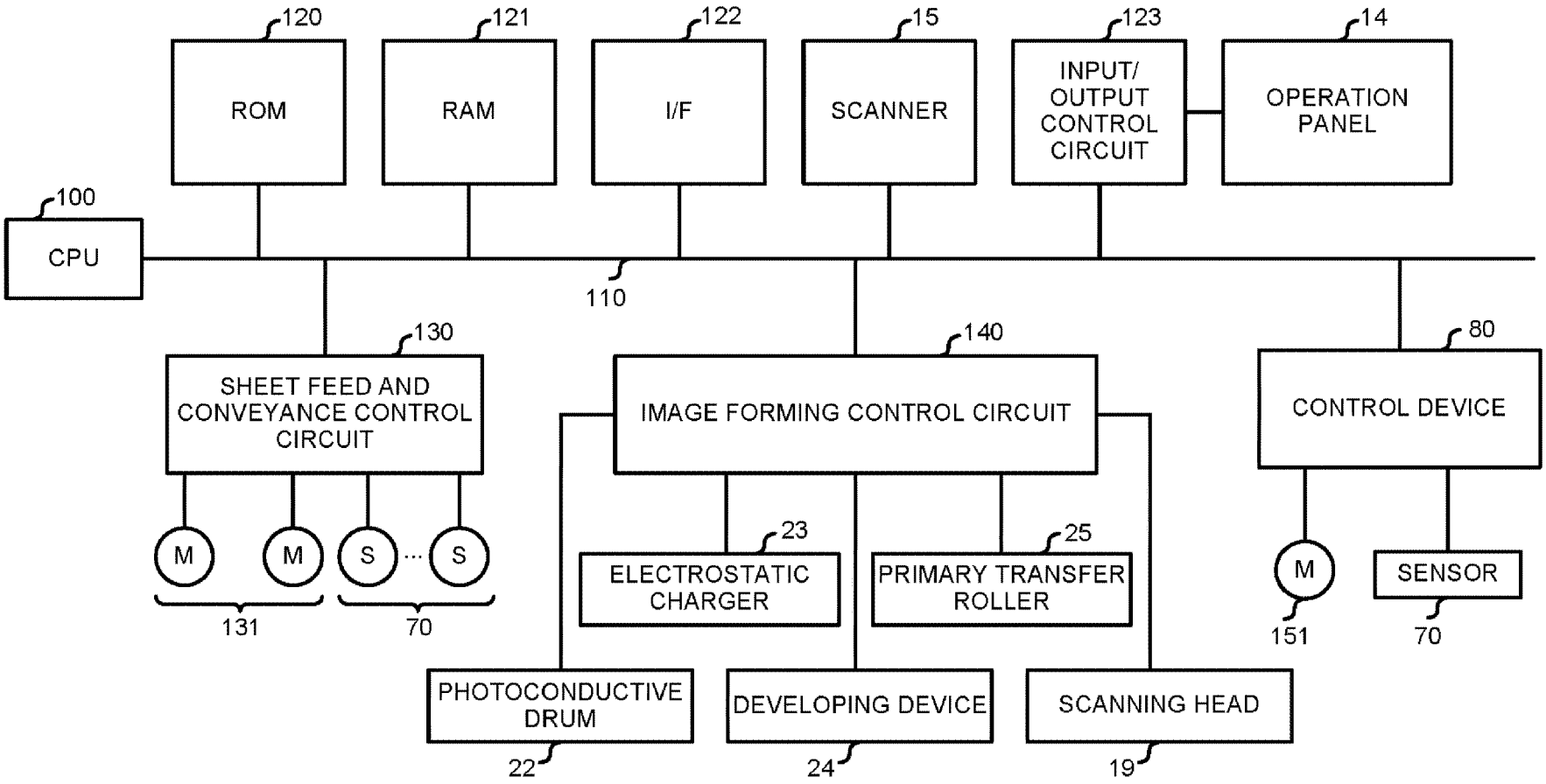
FIG. 4 is a block diagram illustrating a control system of the image forming apparatus according to the embodiment.

FIG. 4 is a block diagram illustrating a control system of the MFP 10. The control system includes, for example, a Central Processing Unit (CPU) 100 that controls the entire image forming apparatus, a bus line 110, a Read Only Memory (ROM) 120, a Random Access Memory (RAM) 121, an interface 122, the scanner 15, an input/output control circuit 123, a sheet feed and conveyance control circuit 130, an image forming control circuit 140 and the control device 80. The CPU 100 and each circuit are connected to each other via the bus line 110.

The ROM 120 stores control programs and control data for defining basic operations of an image forming processing. The RAM 121 functions as a working memory serving as a work area of the CPU 100. The CPU 100 executes a program stored in the ROM 120. In this way, the CPU 100 collectively controls components of the MFP 10 to sequentially execute processing for forming an image on the sheet P.

The interface 122 establishes communication with devices such as a terminal used by a user and the like. The interface 122 includes a wireless communication circuit such as a wireless Local Area Network (LAN), a wired communication circuit, a communication circuit using a recording medium such as a Universal Serial Bus (USB) memory, and the like.

The input/output control circuit 123 displays required information on the operation panel 14 and receives input from the operation panel 14. The user can operate the operation panel 14 to designate, for example, a sheet size, the number of copies of a document, and the like.

The sheet feed and conveyance control circuit 130 controls a motor group 131 for driving the pickup roller 18*a*, the sheet feed roller 35 or the sheet discharge roller 37 on the conveyance path. Based on a control signal from the CPU 100, the sheet feed and conveyance control circuit 130 controls the motor group 131 according to detection results from various sensors 70 arranged in the vicinity of the sheet feed cassette 18 or in the conveyance path or the like.

The image forming control circuit 140 controls the photoconductive drum 22, the electrostatic charger 23, the scanning heads 19Y, 19M, 19C and 19 K, the developing device 24 and the primary transfer roller 25 based on control signals from the CPU 100, respectively.

The control device 80 controls, for example, a drive motor 151 for rotating the pressure roller 52 of the fixing device 50 based on a control signal from the CPU 100.

[Image Formation Processing]

In the MFP 10, an image forming processing for performing printing on the sheet P is performed in response to a print command from the user. The image forming processing is performed, for example, in a case in which image data received via the interface 122 is printed or in a case in which image data generated by the scanner 15 is printed.

In the image forming processing, as shown in FIG. 1, the sheet P is pulled out of the sheet feed cassette 18 by the pickup roller 18*a*, and is conveyed between the intermediate transfer belt 21 and the secondary transfer roller 33 by the sheet feed roller 35.

In parallel with the above operation, the toner images are formed on the photoconductive drums 22 in the image forming sections 20Y 20M, 20C and 20K, respectively. The toner images respectively formed on the photoconductive drums 22 in the image forming sections 20Y, 20M, 20C and 20K are sequentially transferred onto the intermediate transfer belt 21. In this way, toner images formed with a yellow (Y) toner, a magenta (M) toner, a cyan (C) toner and a black (K) toner are formed on the intermediate transfer belt 21.

At the time the sheet P conveyed between the intermediate transfer belt 21 and the secondary transfer roller 33 passes through the intermediate transfer belt 21 and the secondary transfer roller 33, the toner images formed on the intermediate transfer belt 21 are transferred onto the sheet P. In this way, the toner images formed with the yellow (Y) toner, the magenta (M) toner, the cyan (C) toner and the black (K) toner are formed on the sheet P.

The sheet P on which the toner image is formed passes through the fixing device 50. The sheet P is heated by passing through the fixing device 50. In this way, the toner image transferred onto the sheet P is fixed to the sheet P, and an image is formed on the sheet P. The sheet P on which the image is formed is discharged by the sheet discharge roller 37 to the sheet discharge section 38.

[Operation Performed by the Fixing Device]

Figure 5:
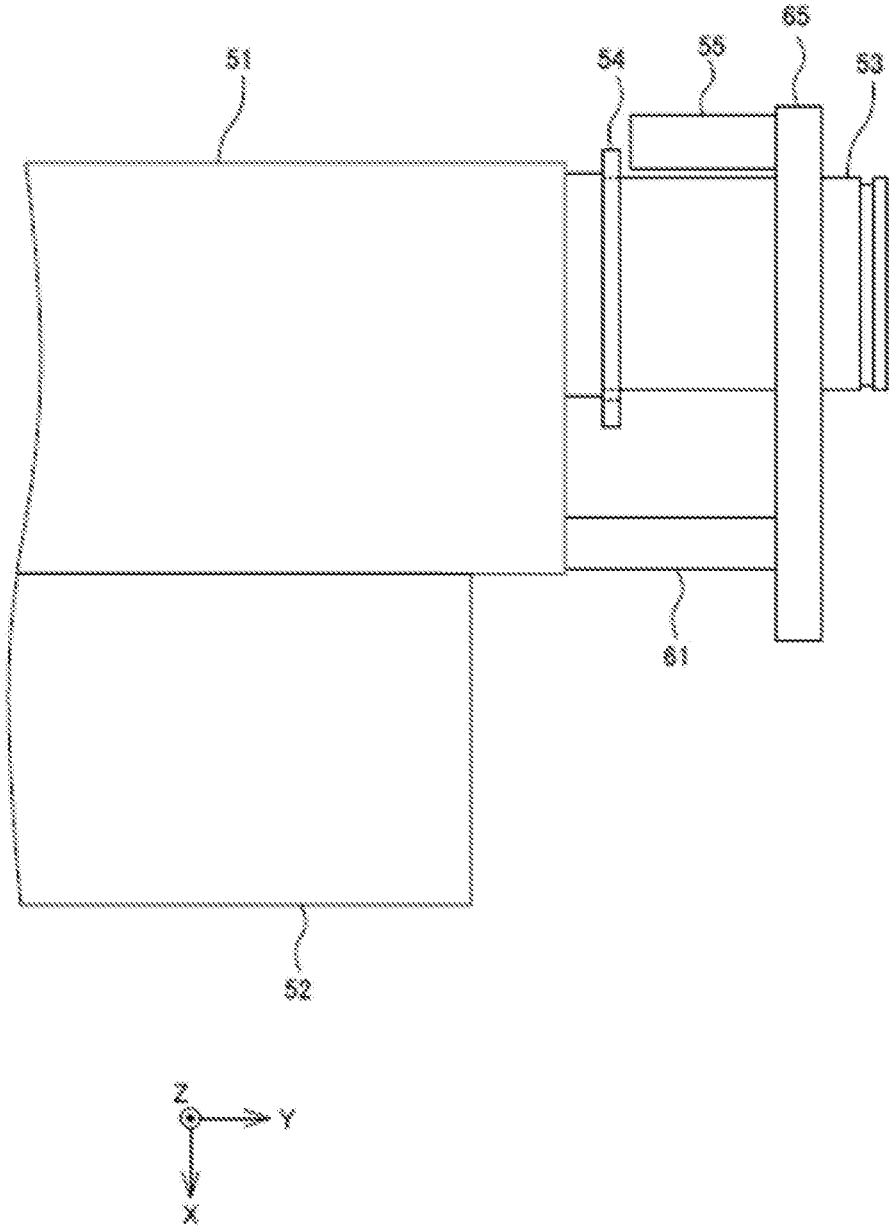
FIG. 5 is a diagram illustrating an operation performed by the fixing device according to the embodiment.

Before rotation, the fixing belt 51 is separated from the belt regulating plate 54, as shown in FIG. 5. An XZ plane of the belt regulating plate 54 is perpendicular to the axial direction (Y-axis direction) of the rotation axis of the heating roller 53.

Figure 6:
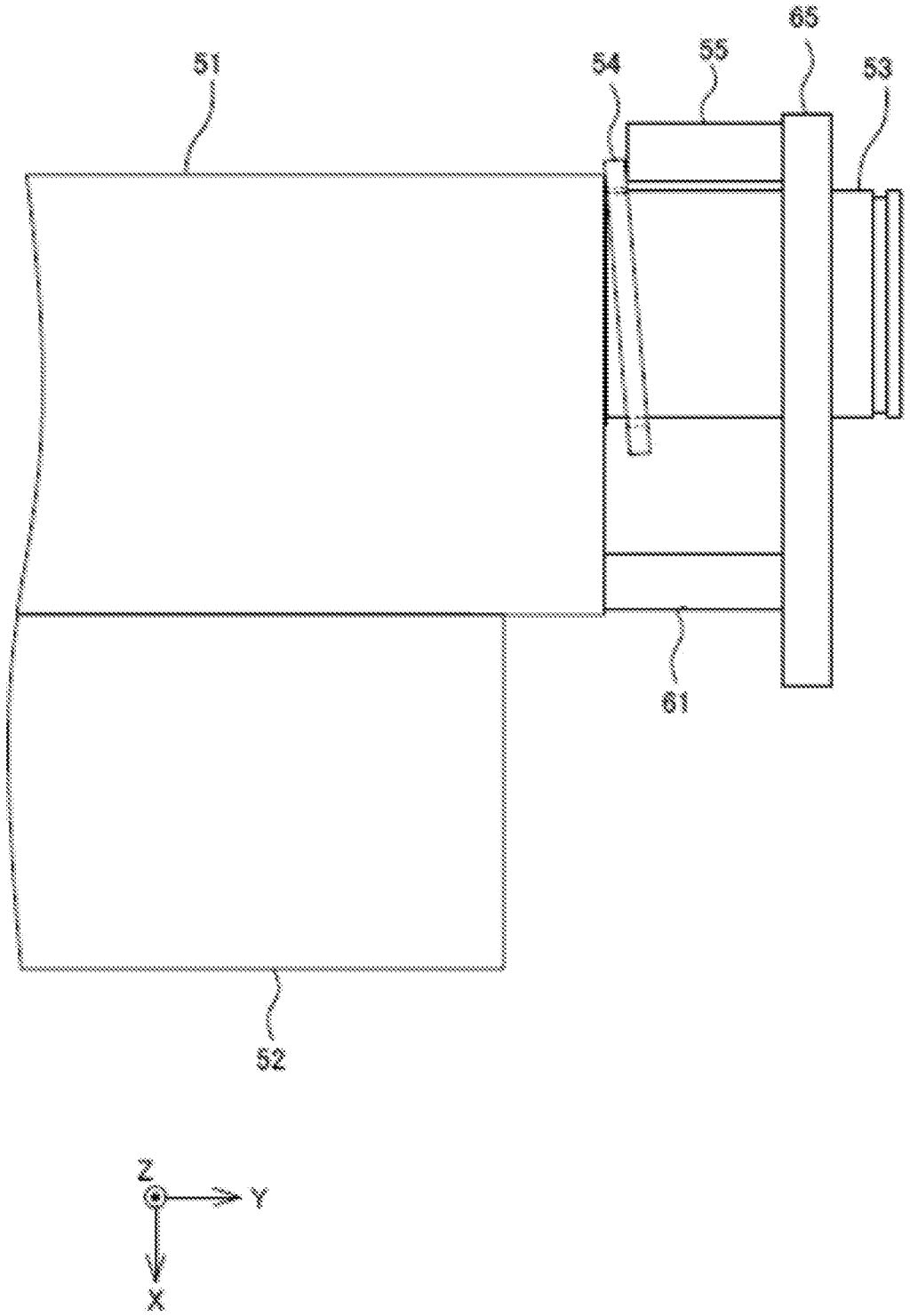
FIG. 6 is a diagram illustrating an operation performed by the fixing device according to the embodiment.

When the fixing belt 51 rotates around the heating roller 53 and the pressure pad 61 as the pressure roller 52 rotates, the fixing belt 51 may move in the +Y direction. As shown in FIG. 6, if the fixing belt 51 moves in the +Y direction, the fixing belt 51 pushes the belt regulating plate 54 in the +Y direction. Since the belt regulating plate 54 is loosely fitted to the heating roller 53, the belt regulating plate 54 can be moved in the axial direction (Y-axis direction) of the heating roller 53. The belt regulating plate 54 pushed in the +Y direction moves in the +Y direction along the axial direction of the heating roller 53. The belt regulating plate 54 moved in the +Y direction contacts the stopper 55, and thus cannot move further in the +Y direction. The belt regulating plate 54 pushes the fixing belt 51 back in the −Y direction with a reaction force corresponding to a force of the fixing belt 51 to press the belt regulating plate 54. The fixing belt 51 is returned in the −Y direction.

The belt regulating plate 54 has a ring shape, and an inner diameter of the opening thereof is larger than the outer diameter of the heating roller 53. A portion of the belt regulating plate 54 on the −X side shown in FIG. 6 is pushed to the −Y side by the stopper 55, but a portion of the belt regulating plate 54 on the +X side shown in FIG. 6 is not pushed to the −Y side. Therefore, as shown in FIG. 6, the XZ plane of the belt regulating plate 54 is inclined with respect to the axial direction (Y-axis direction) of the heating roller 53. In this way, the belt regulating plate 54 contacts only an outer edge of the area contacting the heating roller 53 in the fixing belt 51 to prevent the fixing belt 51 from moving in the axial direction of the heating roller 53.

An inner circumferential surface of the portion of the belt regulating plate 54 on the −X side shown in FIG. 6 which is pressed by the stopper 55 closely contacts the heating roller 53. In this way, the thin fixing belt 51 is prevented from being caught between the belt regulating plate 54 and the heating roller 53, and the belt regulating plate 54 can push the fixing belt 51 back to the −Y side.

In the area contacting the heating roller 53 in the fixing belt 51, the external pressure applied to the fixing belt 51 is distributed to the heating roller 53, and thus the fixing belt 51 is difficult to buckle or damage even if the external pressure is applied. However, in the area not contacting the heating roller 53 in the fixing belt 51, the external pressure applied to the fixing belt 51 is not distributed to the heating roller 53, and thus, the fixing belt 51 is easy to buckle or damage due to the applied external pressure. Since the belt regulating plate 54 is inclined with respect to the axial direction of the heating roller 53, the portion of the belt regulating plate 54 on the +X side shown in FIG. 6 which is not pressed by the stopper 55 is separated from the fixing belt 51. At least a force of the portion not pressed by the stopper 55 in the belt regulating plate 54 to press the fixing belt 51 is smaller than a force of the portion pressed by the stopper 55 in the belt regulating plate 54 to press the fixing belt 51. Therefore, the force applied to the outer edge of the area not contacting the heating roller 53 in the fixing belt 51 is suppressed.

As described above, the belt regulating plate 54 contacts only the outer edge of the area contacting the heating roller 53 in the fixing belt 51, to prevent the fixing belt 51 from moving in the axial direction of the rotation axis of the heating roller 53. Since the belt regulating plate 54 does not apply the external pressure to the outer edge of the area not contacting the heating roller 53 in the fixing belt 51, the buckling and damage of the fixing belt 51 can be prevented.

The inner diameter of the opening of the belt regulating plate 54 is larger than the outer diameter of the heating roller 53. Therefore, the belt regulating plate 54 is tiltable with respect to the axial direction of the heating roller 53. The stopper 55 is arranged in such a manner that the belt regulating plate 54 pushes only the outer edge of the area contacting the heating roller 53 in the fixing belt 51. When inclined by being pushed by the stopper 55, the belt regulating plate 54 contacts only the outer edge of the area contacting the heating roller 53 in the fixing belt 51. Thus, the belt regulating plate 54 can suppress the buckling and damage of the fixing belt 51 while also preventing the fixing belt 51 from moving in the axial direction of the rotation axis of the heating roller 53. The inner circumferential surface of the belt regulating plate 54 at the portion pressed by the stopper 55 closely contacts the heating roller 53. In this way, the thin fixing belt 51 can be prevented from being caught between the belt regulating plate 54 and the heating roller 53.

Although FIG. 3 shows a case in which two belt regulating plates 54 are arranged, the number of the belt regulating plates 54 is not limited thereto. The number of the belt regulating plates 54 may be one, two or three.

The shape of the heating roller 53 may be configured such that the belt regulating plate 54 does not move to the fixing belt 51 side from a predetermined position. For example, the outer diameter of the heating roller 53 in an area where the belt regulating plate 54 is not moved is larger than the inner diameter of the opening of the belt regulating plate 54. In this way, a movement range of the belt regulating plate 54 can be restricted. The thin fixing belt 51 can be prevented from being caught between the belt regulating plate 54 and the heating roller 53.

(First Modification)

In the embodiment described above, the belt regulating plate 54 having a ring shape is loosely fitted to the heating roller 53. In the first modification, another embodiment is described in which the belt regulating plate 54 is arranged to contact only the outer edge of the area contacting the heating roller 53 in the fixing belt 51.

Figure 7:
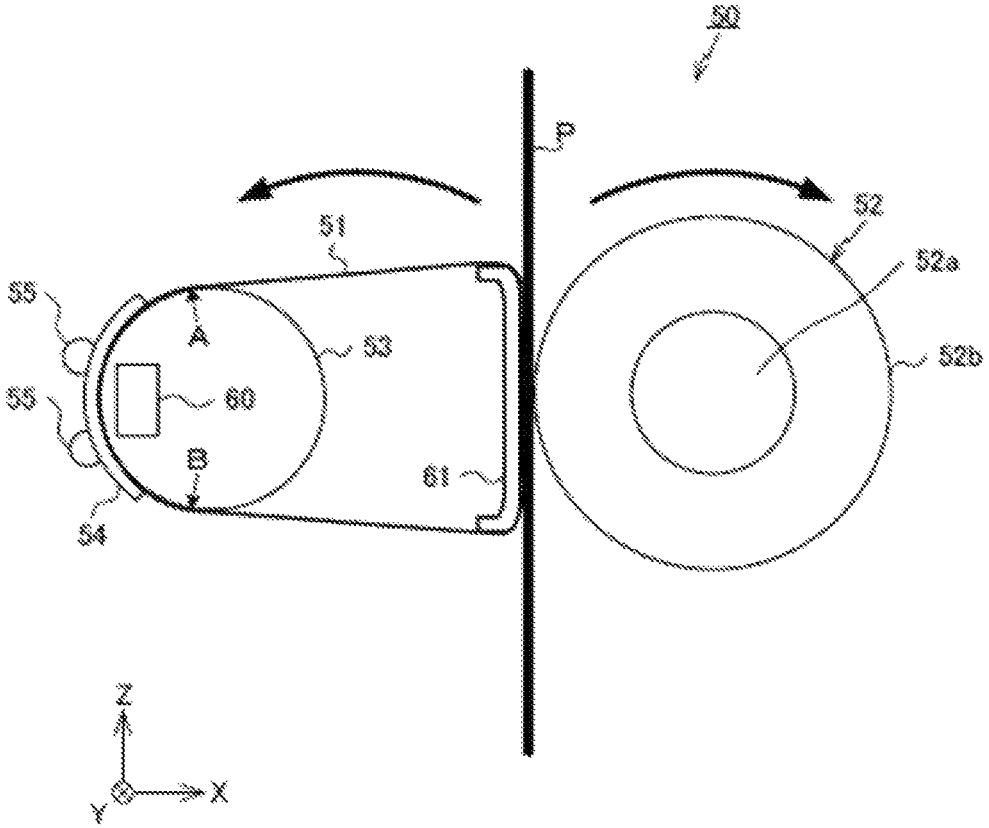
FIG. 7 is a diagram illustrating a configuration of a fixing device according to a first modification.
Figure 8:
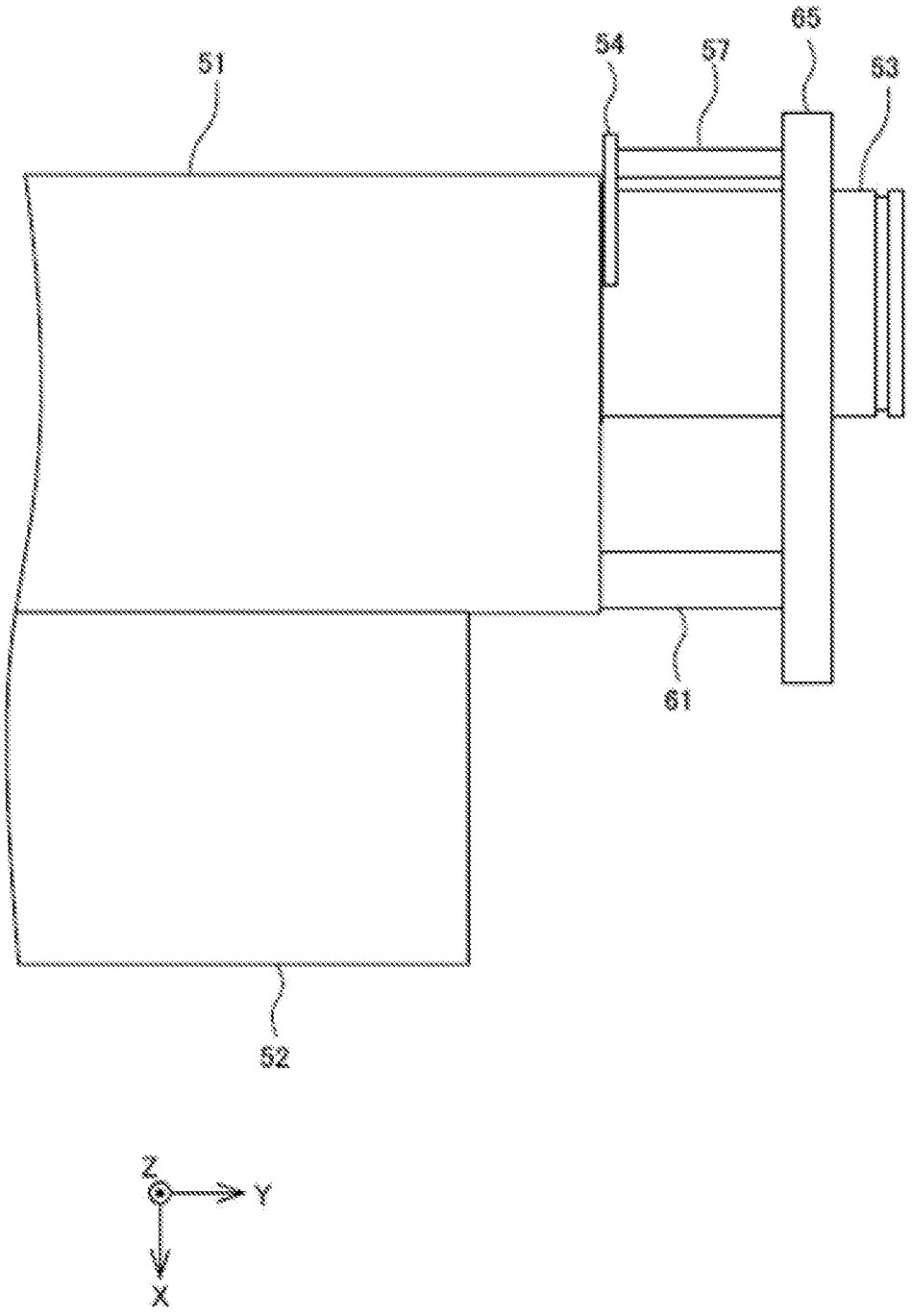
FIG. 8 is a diagram illustrating an operation performed by the fixing device according to the first modification.

FIG. 7 is a diagram illustrating a configuration of the fixing device 50 according to the first modification. The belt regulating plate 54 of the fixing device 50 according to the first modification has a plate-like fan shape. The inner circumferential surface of the belt regulating plate 54 is arranged to contact the outer circumferential surface of the heating roller 53. A radius of the outer circumferential surface of the belt regulating plate 54 is larger than a radius of the heating roller 53. A difference between the radius of the outer circumferential surface of the belt regulating plate 54 and the radius of the heating roller 53 is equal to or greater than 1 mm and equal to or smaller than 3 mm. As shown in FIG. 7, the belt regulating plate 54 is provided in an area extending from A to B of the fixing belt 51 in the counterclockwise direction. A and B shown in FIG. 7 indicate positions where the fixing belt 51 is separated from the heating roller 53. As shown in FIG. 8, the belt regulating plate 54 is fixed to the housing 65 via a support column 57.

As shown in FIG. 7, the belt regulating plate 54 according to the first modification contacts only the outer edge of the area contacting the heating roller 53 in the fixing belt 51. Since the belt regulating plate 54 does not apply the external pressure to the outer edge of the area not contacting the heating roller 53 in the fixing belt 51, the buckling and damage of the fixing belt 51 can be prevented.

(Second Modification)

Figure 9:
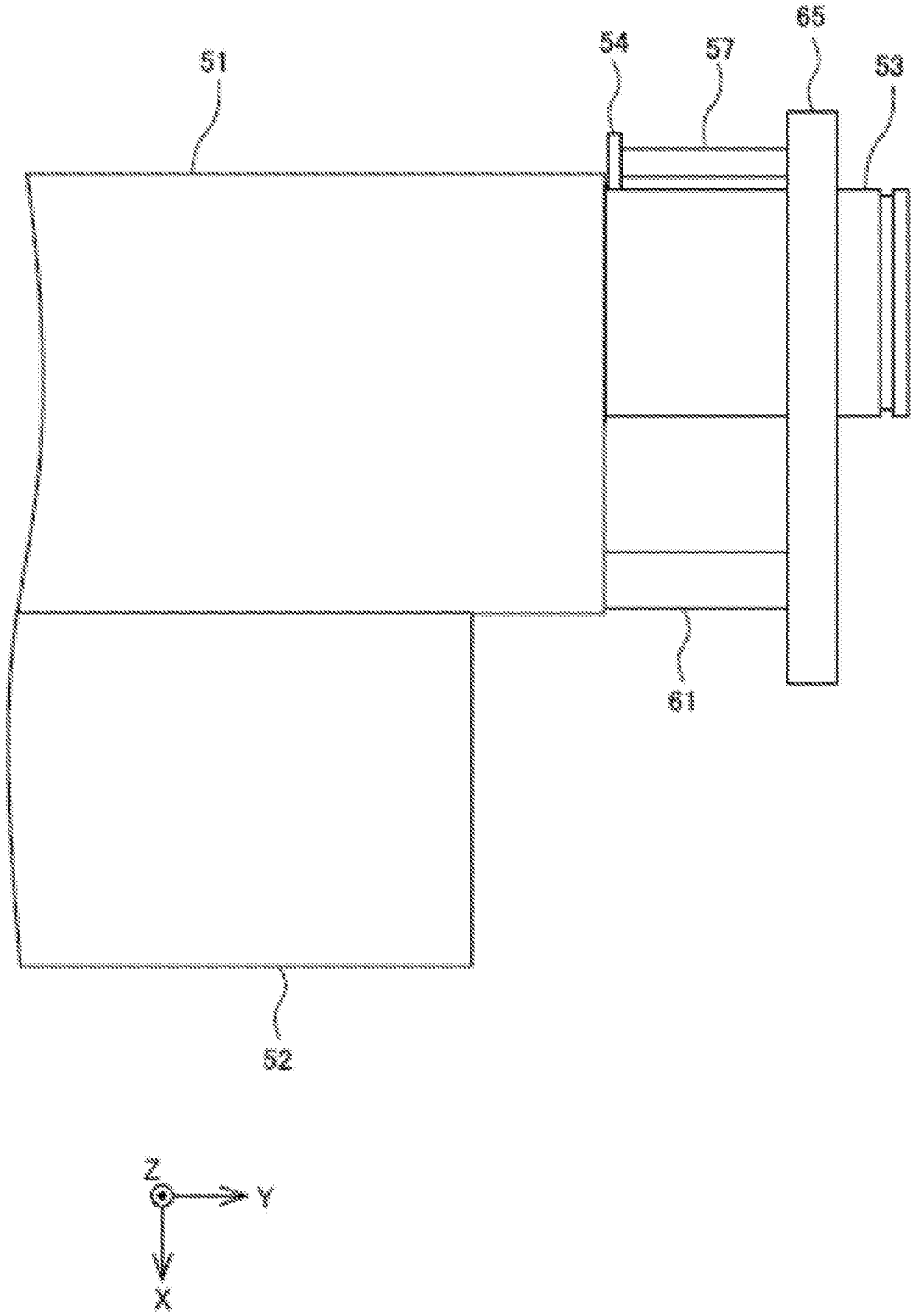
FIG. 9 is a diagram illustrating an operation performed by a fixing device according to a second modification.

In the second modification, another embodiment is described in which the belt regulating plate 54 is provided so as to contact only the outer edge of the area contacting the heating roller 53 in the fixing belt 51. The belt regulating plate 54 is arranged in an area extending from A to B of the fixing belt 51 in the counterclockwise direction shown in FIG. 7. A and B shown in FIG. 7 indicate the positions where the fixing belt 51 is separated from the heating roller 53. As shown in FIG. 9, the belt regulating plate 54 has a cylindrical shape. The belt regulating plate 54 is arranged to contact the outer circumference of the heating roller 53. The outer diameter of the belt regulating plate 54 is equal to or greater than 1 mm and equal to or smaller than 3 mm. For example, the diameter of the belt regulating plate 54 is 3 mm, and the thickness thereof is 2 mm. The belt regulating plate 54 is fixed to the housing 65 via the support column 57. The belt regulating plate 54 according to the second modification contacts only a part of the outer edge of the area contacting the heating roller 53 in the fixing belt 51. Since the belt regulating plate 54 does not apply the external pressure to the outer edge of the area not contacting the heating roller 53 in the fixing belt 51, the buckling and damage of the fixing belt 51 can be prevented.

(Third Modification)

In the above description, the fixing belt 51 is rotatably mounted at the outside of the heating roller 53 and the pressure pad 61. However, an implementation manner of the fixing belt 51 is not limited thereto. For example, as shown in FIG. 10, as the fixing device of the MFP 10, a fixing device 500 including the fixing belt 51 stretched around a plurality of rollers may be used.

Figure 10:
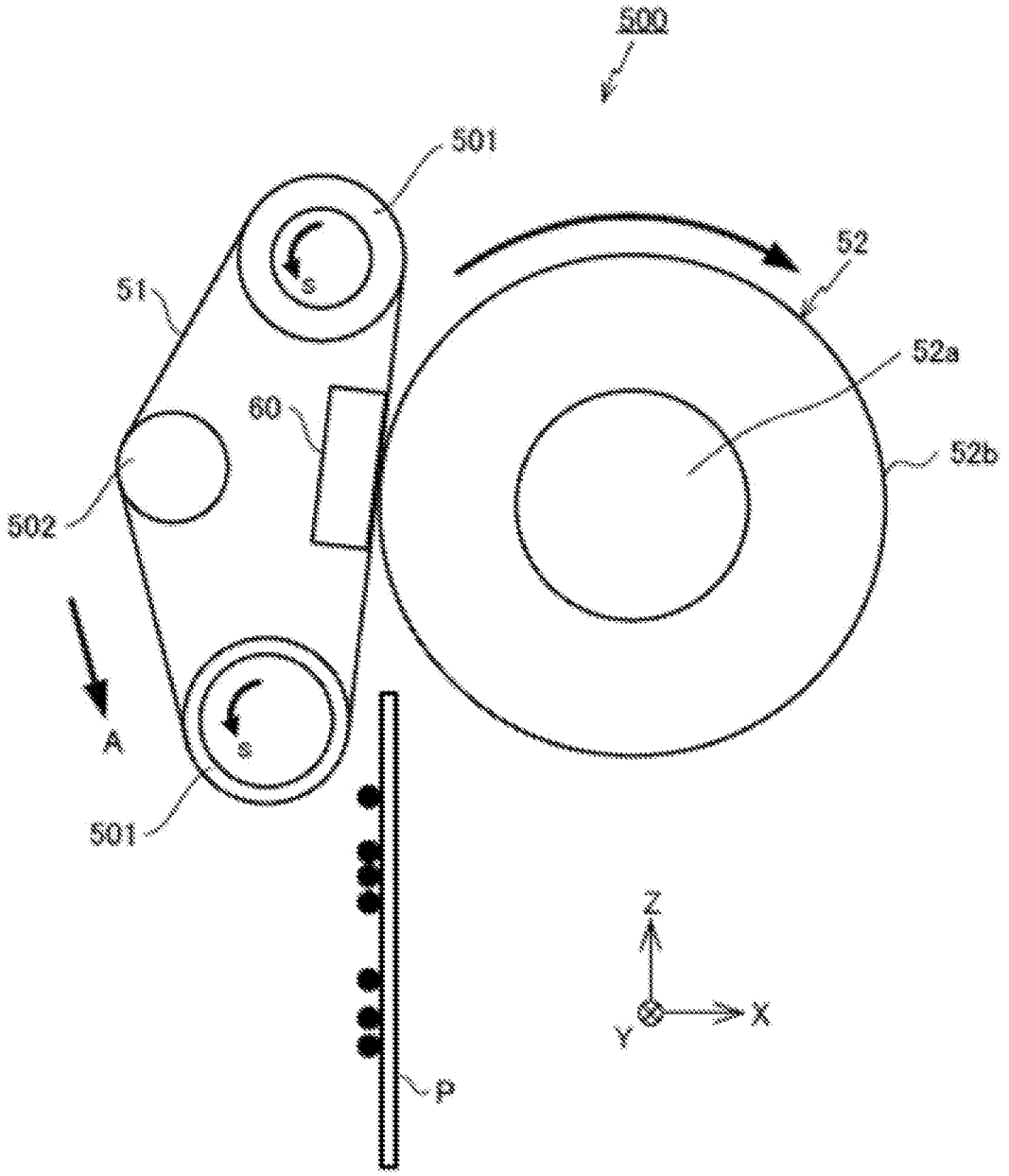
FIG. 10 is a diagram illustrating a configuration of a fixing device according to a third modification.

As shown in FIG. 10, in the fixing device 500, the fixing belt 51 is stretched around a drive roller 501 for rotating the fixing belt 51 and a tension roller 502 for applying tension to the fixing belt 51. The drive roller 501 rotates in a direction indicated by an arrow s, and in this way, the fixing belt 51 rotates in a direction indicated by an arrow A.

In the fixing device 500, the pressure roller 52 is pressed against the fixing belt 51 heated by the heater 60 to form a nip between the fixing belt 51 and the pressure roller 52. At the time the sheet P onto which the toner image is transferred passes through the nip upward, the sheet P is heated by the heater 60 via the fixing belt 51. In this way, the toner image is fixed to the sheet P, and an image is formed on the sheet P.

In the example shown in FIG. 10, by arranging the belt regulating plate 54 and the stopper 55 in at least one of the drive roller 501 and the tension roller 502, the buckling and damage of the fixing belt 51 occurring when the displacement of the fixing belt 51 in the axial direction of the drive roller 501 is restricted can be prevented.

In the above embodiment, the fixing device 50 is a fixing device of a type for heating the sheet P with the heater 60 via a film-like fixing belt 51. However, the fixing device 50 may heat the fixing belt 51 with a halogen heater. The fixing device 50 may be an induction heating type fixing device that heats the fixing belt 51 by applying a high frequency current to the fixing belt 51.

In the above embodiment, the pressure member is a pressure pad. However, it is not limited thereto, and the pressure member may be a fixing roller or the like.

In the above embodiment, the image forming apparatus 10 is a multi-function peripheral. However, it is not limited thereto, and the image forming apparatus 10 may be a laser printer or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and sprit of the inventions.

What is claimed is:

1. A fixing device for fixing a toner image formed on an image receiving medium to the image receiving medium, comprising:

a pressure rotation member;

a pressure member against which the pressure rotation member presses the image receiving medium;

a roller separated from the pressure member and configured to rotate around a rotation axis thereof;

an annular belt wound around the roller and the pressure member;

a heater configured to heat the annular belt;

a belt regulating member defining an opening into which the roller is fitted and including an abutting surface configured to abut against the annular belt, the belt regulating member being movable along a length of the roller; and a stopper arranged to face an outer edge of the annular belt that contacts the roller, wherein the belt regulating member is positioned between the annular belt and the stopper.

2. The fixing device of claim 1, wherein a difference between an inner diameter of the opening of the belt regulating member and an outer diameter of the roller is equal to or greater than 0.1 mm and equal to or smaller than 0.5 mm.

3. The fixing device of claim 1, wherein the belt regulating member has a plate-like circular shape; and wherein an outer diameter of the belt regulating member is larger than that of the roller, and a difference between the outer diameter of the belt regulating member and the outer diameter of the roller is equal to or greater than 1 mm and equal to or smaller than 3 mm.

4. The fixing device of claim 1, wherein the opening of the belt regulating member is larger than an outer diameter of the roller such that the belt regulating member is tiltable relative to the rotation axis of the roller.

5. The fixing device of claim 4, wherein the belt regulating member is configured to tilt relative to the rotation axis of the roller in response to the belt regulating member contacting both the annular belt and the stopper.

6. The fixing device of claim 5, wherein the stopper has a cylindrical shape, one end of the stopper being fixed relative to a housing of the fixing device, and the other end of the stopper being arranged to face an outer edge of an area of the annular belt that contacts the roller, and wherein the belt regulating member is not fixed relative to the stopper.

7. The fixing device of claim 1, wherein the roller is a heating roller, and wherein the heater is arranged inside of the heating roller.

8. An image forming apparatus, comprising:

an image forming section configured to form a toner image on an image receiving medium; and a fixing device configured to fix the toner image formed on the image receiving medium to the image receiving medium, the fixing device comprising:

a pressure rotation member;

a heating roller configured to rotate around a rotation axis thereof;

an annular belt wound around the heating roller, wherein the pressure rotation member is configured to press the image receiving medium against the annular belt;

a belt regulating member defining an opening into which the heating roller is loosely fitted and an abutting surface abutting against the annular belt, the belt regulating member being movable along a length of the heating roller; and a stopper arranged to face an outer edge of the annular belt that contacts the heating roller, wherein the belt regulating member extends between the annular belt and the stopper.

9. The image forming apparatus of claim 8, wherein the fixing device further comprises a pressure member against which the pressure rotation member is pressed across the image receiving medium, wherein the annular belt is wound around the heating roller and the pressure member, and wherein the heating roller is separated from the pressure member.

10. The image forming apparatus of claim 8, wherein the fixing device further comprises a drive roller configured to rotate the annular belt, wherein the annular belt is wound around the heating roller and the drive roller.

11. The image forming apparatus of claim 8, wherein the opening of the belt regulating member is larger than an outer diameter of the heating roller such that the belt regulating member is tiltable relative to the rotation axis of the heating roller.

12. The image forming apparatus of claim 11, wherein the belt regulating member is configured to tilt relative to the rotation axis of the heating roller in response to the belt regulating member contacting both the annular belt and the stopper.

13. The image forming apparatus of claim 12, wherein the stopper has a cylindrical shape, one end of the stopper being fixed relative to a housing of the fixing device, and the other end of the stopper being arranged to face an outer edge of an area of the annular belt that contacts the heating roller, and wherein the belt regulating member is not fixed relative to the stopper.

14. The fixing device of claim 1, wherein the stopper is arranged to face an outer edge of a first area of the annular belt that contacts the roller.

15. The fixing device of claim 14, wherein the stopper is arranged to face the outer edge of the first area of the annular belt that contacts the roller without facing a second area of the annular belt that does not contact the roller.

16. The image forming apparatus of claim 8, wherein the stopper is arranged to face an outer edge of a first area of the annular belt that contacts the roller.

17. The image forming apparatus of claim 16, wherein the stopper is arranged to face the outer edge of the first area of the annular belt that contacts the roller without facing a second area of the annular belt that does not contact the roller.

18. The fixing device of claim 1, wherein the stopper has a cylindrical shape, one end of the stopper being fixed relative to a housing of the fixing device, and the other end of the stopper being arranged to face an outer edge of an area of the annular belt that contacts the roller, and wherein the belt regulating member is not fixed relative to the stopper.

19. The fixing device of claim 18, wherein the cylindrical shape of the stopper is offset from the rotation axis of the roller.

20. The image forming apparatus of claim 8, wherein the stopper has a cylindrical shape, one end of the stopper being fixed relative to a housing of the fixing device, and the other end of the stopper being arranged to face an outer edge of an area of the annular belt that contacts the heating roller, and wherein the belt regulating member is not fixed relative to the stopper.

* * * * *